US005998347A

United States Patent [19]

D'Ambrogio et al.

[11] Patent Number: 5,998,347

[45] Date of Patent: Dec. 7, 1999

[54] HIGH FOAMING GREASE CUTTING LIGHT DUTY LIQUID COMPOSITION CONTAINING A C10 ALKYL AMIDO PROPYL DIMETHYL AMINE OXIDE

[75] Inventors: Robert D'Ambrogio, Bound Brook; Gary Jakubicki, Robbinsville; Evangelia Arvanitidou, Kendall Park; Joan Gambogi, Belle Mead, all of N.J.

[73] Assignee: Colgate Palmolive Company, New York, N.Y.

[21] Appl. No.: 09/354,030

[22] Filed: Jul. 15, 1999

[51] Int. Cl.[6] ..... C11D 1/22; C11D 1/29; C11D 1/83; C11D 3/30

[52] U.S. Cl. ..... 510/237; 510/428; 510/433; 510/470; 510/501; 510/503

[58] Field of Search ..... 510/237, 428, 510/433, 501, 503, 470

[56] References Cited

U.S. PATENT DOCUMENTS

| | | | |
|---|---|---|---|
| 5,736,503 | 4/1998 | Vinson | 510/481 |
| 5,780,415 | 7/1998 | Leonard et al. | 510/417 |
| 5,869,439 | 2/1999 | Thomas et al. | 510/235 |

*Primary Examiner*—Mark Kopec
*Assistant Examiner*—Gregory R. Delcotto
*Attorney, Agent, or Firm*—Richard E. Nanfeldt

[57] ABSTRACT

A light duty, liquid comprising: a $C_8$–$C_{18}$ ethoxylated alkyl ether sulfate surfactant, a magnesium salt of a $C_8$–$C_{18}$ linear alkyl benzene sulfonate, a sodium salt of a $C_8$–$C_{18}$ linear alkyl benzene sulfonate, an amine oxide, a polyalkylglucoside, and water.

4 Claims, No Drawings

HIGH FOAMING GREASE CUTTING LIGHT DUTY LIQUID COMPOSITION CONTAINING A C10 ALKYL AMIDO PROPYL DIMETHYL AMINE OXIDE

BACKGROUND OF THE INVENTION

The present invention relates to novel light duty liquid detergent compositions with high foaming and good grease cutting properties.

The prior art is replete with light duty liquid detergent compositions containing nonionic surfactants in combination with anionic and/or betaine surfactants wherein the nonionic detergent is not the major active surfactant. In U.S. Pat. No. 3,658,985 an anionic based shampoo contains a minor amount of a fatty acid alkanolamide. U.S. Pat. No. 3,769,398 discloses a betaine-based shampoo containing minor amounts of nonionic surfactants. This patent states that the low foaming properties of nonionic detergents renders its use in shampoo compositions non-preferred. U.S. Pat. No. 4,329,335 also discloses a shampoo containing a betaine surfactant as the major ingredient and minor amounts of a nonionic surfactant and of a fatty acid mono- or di-ethanolamide. U.S. Pat. No. 4,259,204 discloses a shampoo comprising 0.8 to 20% by weight of an anionic phosphoric acid ester and one additional surfactant which may be either anionic, amphoteric, or nonionic. U.S. Pat. No. 4,329,334 discloses an anionic-amphoteric based shampoo containing a major amount of anionic surfactant and lesser amounts of a betaine and nonionic surfactants.

U.S. Pat. No. 3,935,129 discloses a liquid cleaning composition containing an alkali metal silicate, urea, glycerin, triethanolamine, an anionic detergent and a nonionic detergent. The silicate content determines the amount of anionic and/or nonionic detergent in the liquid cleaning composition. However, the foaming properties of these detergent compositions are not discussed therein.

U.S. Pat. No. 4,129,515 discloses a heavy duty liquid detergent for laundering fabrics comprising a mixture of substantially equal amounts of anionic and nonionic surfactants, alkanolamines and magnesium salts, and, optionally, zwitterionic surfactants as suds modifiers.

U.S. Pat. No. 4,224,195 discloses an aqueous detergent composition for laundering socks or stockings comprising a specific group of nonionic detergents, namely, an ethylene oxide of a secondary alcohol, a specific group of anionic detergents, namely, a sulfuric ester salt of an ethylene oxide adduct of a secondary alcohol, and an amphoteric surfactant which may be a betaine, wherein either the anionic or nonionic surfactant may be the major ingredient.

The prior art also discloses detergent compositions containing all nonionic surfactants as shown in U.S. Pat. Nos. 4,154,706 and 4,329,336 wherein the shampoo compositions contain a plurality of particular nonionic surfactants in order to affect desirable foaming and detersive properties despite the fact that nonionic surfactants are usually deficient in such properties.

U.S. Pat. No. 4,013,787 discloses a piperazine based polymer in conditioning and shampoo compositions which may contain all nonionic surfactant or all anionic surfactant.

U.S. Pat. No. 4,450,091 discloses high viscosity shampoo compositions containing a blend of an amphoteric betaine surfactant, a polyoxybutylenepolyoxyethylene nonionic detergent, an anionic surfactant, a fatty acid alkanolamide and a polyoxyalkylene glycol fatty ester. But, none of the exemplified compositions contain an active ingredient mixture wherein the nonionic detergent is present in major proportion which is probably due to the low foaming properties of the polyoxybutylene polyoxyethylene nonionic detergent.

U.S. Pat. No. 4,595,526 describes a composition comprising a nonionic surfactant, a betaine surfactant, an anionic surfactant and a $C_{12}$–$C_{14}$ fatty acid monoethanolamide foam stabilizer.

SUMMARY OF THE INVENTION

It has now been found that a high foaming liquid detergent properties which has good grease cutting properties can be formulated with a sodium salt of a $C_8$–$C_{18}$ linear alkyl benzene sulfonate, a magnesium salt of a $C_8$–$C_{18}$ linear alkyl benzene sulfonate, a $C_{10}$ alkyl amido propyl dimethyl amine oxide, an alkyl polyglucoside, a $C_8$–$C_{18}$ ethoxylated alkyl ether sulfate and water.

Accordingly, one object of this invention is to provide novel, high foaming, light duty liquid detergent compositions containing an alpha olefin sulfonate surfactant.

To achieve the foregoing and other objects and in accordance with the purpose of the present invention, as embodied and broadly described herein the novel, high foaming, light duty liquid detergent of this invention comprises a $C_8$–$C_{18}$ ethoxylated alkyl ether sulfate, a magnesium salt of a $C_8$–$C_{18}$ linear alkyl benzene sulfonate, sodium salt of a $C_8$–$C_{18}$ linear alkyl benzene sulfonate, an alkyl polyglucoside, a $C_{10}$ alkyl amido propyl dimethyl amine oxide, and water, wherein the composition does not contain a glycol ether solvent, an ethoxylated and/or propoxylated nonionic surfactant, a zwitterionic surfactant, a polyoxyalkylene glycol fatty acid, a builder, a polymeric thickener, an acid, a clay, a fatty acid alkanol amide, abrasive, silicas, tricloscan, alkaline earth metal carbonates, alkyl glycine surfactant, cyclic imidinium surfactant, or more than 0.2 wt. % of a perfume or water insoluble hydrocarbon and the composition does not contain an amine oxide having $C_8$–$C_9$ carbon atoms or $C_{11}$ to $C_{24}$ carbon atoms.

DETAILED DESCRIPTION OF THE INVENTION

The present invention relates to a light duty liquid detergent which comprises approximately by weight:

(a) 6% to 15% of a magnesium salt of a $C_8$–$C_{18}$ linear alkyl sulfonate surfactant;

(b) 1% to 5% of a sodium salt of a $C_8$–$C_{18}$ linear alkyl sulfonate surfactant;

(c) 3% to 12% of a $C_{10}$ alkyl amido propyl dimethyl amine oxide surfactant;

(d) 5% to 15% of an alkyl polyglucoside surfactant;

(e) 7% to 15% of a $C_8$–$C_{18}$ ethoxylated alkyl ether sulfate; and (f) the balance being water wherein the composition does not contain a glycol ether solvent, an ethoxylated and/or propoxylated nonionic surfactant, a zwitterionic surfactant, a polyoxyalkylene glycol fatty acid, a builder, a polymeric thickener, an acid, a clay, a fatty acid alkanol amide, abrasive, silicas, triclosan, alkaline earth metal carbonates, alkyl glycine surfactant, cyclic imidinium surfactant, or more than 0.2 wt. % of a perfume or water insoluble hydrocarbon and the composition does not contain an amine oxide having $C_8$–$C_9$ carbon atoms or $C_{11}$ to $C_{24}$ carbon atoms.

The $C_8$–$C_{18}$ ethoxylated alkyl sulfate surfactants which can be used in the instant compositions at a concentration of 7 to about 15 wt. %, more preferably about 8 to 18 wt. % have the structure

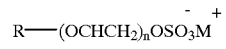

wherein n is about 1 to about 22 more preferably 1 to 3 and R is an alkyl group having about 8 to about 18 carbon atoms, more preferably 12 to 15 and natural cuts, for example, $C_{12-14}$; $C_{12-15}$ and M is an ammonium cation, alkali metal or an alkaline earth metal cation, most preferably magnesium, sodium or ammonium. The ethoxylated alkyl ether sulfate is generally present in the composition at a concentration of about 0 to about 20 wt. %, more preferably about 0.5 wt. % to 15 wt. %.

The ethoxylated alkyl ether sulfate may be made by sulfating the condensation product of ethylene oxide and $C_{8-10}$ alkanol, and neutralizing the resultant product. The ethoxylated alkyl ether sulfates differ from one another in the number of carbon atoms in the alcohols and in the number of moles of ethylene oxide reacted with one mole of such alcohol. Preferred ethoxylated alkyl ether polyethenoxy sulfates contain 12 to 15 carbon atoms in the alcohols and in the alkyl groups thereof, e.g., sodium myristyl (3 EO) sulfate.

Ethoxylated $C_{8-18}$ alkylphenyl ether sulfates containing from 2 to 6 moles of ethylene oxide in the molecule are also suitable for use in the invention compositions.

These detergents can be prepared by reacting an alkyl phenol with 2 to 6 moles of thylene oxide and sulfating and neutralizing the resultant ethoxylated alkylphenol. The concentration of the ethoxylated alkyl ether sulfate surfactant is about 1 to about 8 wt. %.

The alkali metal or salt of the $C_8$–$C_{18}$ linear alkyl benzene sulfonate surfactant is generally used in the instant compositions at a concentration of about 1 to 5 wt. %, more preferably about 2 wt. % to about 4 wt. %. The alkaline urea metal salt of the $C_8$–$C_{18}$ linear alkyl benzene sulfonate surfactant is used at a concentration of 6 wt. % to 15 wt. %, more preferably 8 wt. % to 13 wt. %. Examples of suitable sulfonated anionic surfactants are the well known higher alkyl mononuclear aromatic sulfonates such as the higher alkyl benzene sulfonates containing from 8 to 18 carbon atoms, more preferably 10 to 16 carbon atoms in the higher alkyl group in a straight or branched chain, $C_8$–$C_{15}$ alkyl toluene sulfonates and $C_8$–$C_{15}$ alkyl phenol sulfonates.

One of preferred sulfonates is linear alkyl benzene sulfonate having a high content of 3-(or higher) phenyl isomers and a correspondingly low content (well below 50%) of 2-(or lower) phenyl isomers, that is, wherein the benzene ring is preferably attached in large part at the 3 or higher (for example, 4, 5, 6 or 7) position of the alkyl group and the content of the isomers in which the benzene ring is attached in the 2 or 1 position is correspondingly low. Particularly preferred materials are set forth in U.S. Pat. No. 3,320,174.

The instant compositions can contain about 5 to about 15 wt. %, more preferably 7 to 12 wt. % of an alkyl polysaccharide surfactant. The alkyl polysaccharides surfactants, which are used in conjunction with the aforementioned surfactant have a hydrophobic group containing from about 8 to about 20 carbon atoms, preferably from about 10 to about 16 carbon atoms, most preferably from about 12 to about 14 carbon atoms, and polysaccharide hydrophilic group containing from about 1.5 to about 10, preferably from about 1.5 to about 4, most preferably from about 1.6 to about 2.7 saccharide units (e.g., galactoside, glucoside, fructoside, glucosyl, fructosyl; and or galactosyl units). Mixtures of saccharide moieties may be used in the alkyl polysaccharide surfactants. The number x indicates the number of saccharide units in a particular alkyl polysaccharide surfactant. For a particular alkyl polysaccharide molecule x can only assume integral values. In any physical sample of alkyl polysaccharide surfactants there will be in general molecules having different x values. The physical sample can be characterized by the average value of x and this average value can assume non-integral values. In this specification the values of x are to be understood to be average values. The hydrophobic group (R) can be attached at the 2-, 3-, or 4-positions rather than at the 1-position, (thus giving e.g. a glucosyl or galactosyl as opposed to a glucoside or galactoside). However, attachment through the 1-position, i.e., glucosides, galactoside, fructosides, etc., is preferred. In the preferred product the additional saccharide units are predominately attached to the previous saccharide unit's 2-position. Attachment through the 3-, 4-, and 6-positions can also occur. Optionally and less desirably there can be a polyalkoxide chain joining the hydrophobic moiety (R) and the polysaccharide chain. The preferred alkoxide moiety is ethoxide.

Typical hydrophobic groups include alkyl groups, either saturated or unsaturated, branched or unbranched containing from about 8 to about 20, preferably from about 10 to about 18 carbon atoms. Preferably, the alkyl group is a straight chain saturated alkyl group. The alkyl group can contain up to 3 hydroxy groups and/or the polyalkoxide chain can contain up to about 30, preferably less than about 10, alkoxide moieties.

Suitable alkyl polysaccharides are decyl, dodecyl, tetradecyl, pentadecyl, hexadecyl, and octadecyl, di-, tri-, tetra-, penta-, and hexaglucosides, galactosides, lactosides, fructosides, fructosyls, lactosyls, glucosyls and/or galactosyls and mixtures thereof.

The alkyl monosaccharides are relatively less soluble in water than the higher alkyl polysaccharides. When used in admixture with alkyl polysaccharides, the alkyl monosaccharides are solubilized to some extent. The use of alkyl monosaccharides in admixture with alkyl polysaccharides is a preferred mode of carrying out the invention. Suitable mixtures include coconut alkyl, di-, tri-, tetra-, and pentaglucosides and tallow alkyl tetra-, penta-, and hexaglucosides.

The preferred alkyl polysaccharides are alkyl polyglucosides having the formula $$R_2O(C_nH_{2n}O)r(Z)x$$

wherein Z is derived from glucose, R is a hydrophobic group selected from the group consisting of alkyl, alkylphenyl, hydroxyalkylphenyl, and mixtures thereof in which said alkyl groups contain from about 10 to about 18, preferably from about 12 to about 14 carbon atoms; n is 2 or 3 preferably 2, r is from 0 to 10, preferable 0; and x is from 1.5 to 8, preferably from 1.5 to 4, most preferably from 1.6 to 2.7. To prepare these compounds a long chain alcohol ($R_2OH$) can be reacted with glucose, in the presence of an acid catalyst to form the desired glucoside. Alternatively the alkyl polyglucosides can be prepared by a two step procedure in which a short chain alcohol ($R_1OH$) can be reacted with glucose, in the presence of an acid catalyst to form the desired glucoside. Alternatively the alkyl polyglucosides can be prepared by a two step procedure in which a short chain alcohol ($C_{1-6}$) is reacted with glucose or a polyglucoside (x=2 to 4) to yield a short chain alkyl glucoside (x=1 to 4) which can in turn be reacted with a longer chain alcohol ($R_2OH$) to displace the short chain alcohol and obtain the desired alkyl polyglucoside. If this two step procedure is used, the short chain alkylglucoside content of the final alkyl polyglucoside material should be less than 50%, preferably less than 10%, more preferably less than about 5%, most preferably 0% of the alkyl polyglucoside.

The amount of unreacted alcohol (the free fatty alcohol content) in the desired alkyl polysaccharide surfactant is preferably less than about 2%, more preferably less than about 0.5% by weight of the total of the alkyl polysaccharide. For some uses it is desirable to have the alkyl monosaccharide content less than about 10%.

The used herein, "alkyl polysaccharide surfactant" is intended to represent both the preferred glucose and galactose derived surfactants and the less preferred alkyl polysaccharide surfactants. Throughout this specification, "alkyl polyglucoside" is used to include alkyl polyglycosides because the stereochemistry of the saccharide moiety is changed during the preparation reaction.

An especially preferred APG glycoside surfactant is APG 625 glycoside manufactured by the Henkel Corporation of Ambler, Pa. APG25 is a nonionic alkyl polyglycoside characterized by the formula:

$$C_nH_{2n+1}O(C_6H_{10}O_5)_xH$$

wherein n=10 (2%); n=122 (65%); n=14 (21–28%); n=16 (4–8%) and n=18 (0.5%) and x (degree of polymerization)= 1.6. APG 625 has: a pH of 6 to 10 (10% of APG 625 in distilled water); a specific gravity at 25° C. of 1.1 g/ml; a density at 25° C. of 9.1 lbs/gallon; a calculated HLB of 12.1 and a Brookfield viscosity at 35° C., 21 spindle, 5–10 RPM of 3,000 to 7,000 cps.

The water is present at a concentration of 40 wt. % to 83 wt. %.

In addition to the previously constituents of the light duty liquid detergent, one may also employ normal and conventional adjuvants, provided they do not adversely affect the properties of the detergent. Thus, there may be used various coloring agents and perfumes; ultraviolet light absorbers such as the Uvinuls, which are products of GAF Corporation; sequestering agents such as ethylene diamine tetraacetates; magnesium sulfate heptahydrate; pH modifiers; etc. The proportion of such adjuvant materials, in total will normally not exceed 15% by weight of the detergent composition, and the percentages of most of such individual components will be a maximum of 5% by weight and preferably less than 2% by weight. Sodium formate or formalin can be included in the formula as a perservative at a concentration of 0.1 to 4.0 wt. %. Sodium bisulfite can be used as a color stabilizer at a concentration of 0.01 to 0.2 wt. %.

The present light duty liquid detergents such as dishwashing liquids are readily made by simple mixing methods from readily available components which, on storage, do not adversely affect the entire composition. Solubilizing agent such as ethanol, sodium chloride and/or sodium cumene or sodium xylene sulfonate and mixtures thereof are used at a concentration of 0.5 wt. % to 8 wt. % to assist in solubilizing the surfactants. The viscosity of the light duty liquid composition desirably will be at least 100 centipoises (cps) at room temperature, but may be up to 1,000 centipoises as measured with a Brookfield Viscometer using a number 3 spindle rotating at 12 rpm. The viscosity of the light duty liquid composition may approximate those of commercially acceptable light duty liquid compositions now on the market. The viscosity of the light duty liquid composition and the light duty liquid composition itself remain stable on storage for lengthy periods of time, without color changes or settling out of any insoluble materials. The pH of the composition is substantially neutral to skin, e.g., 4.5 to 8 and preferably 5.0 to 7.0. The pH of the composition can be adjusted by the addition of $Na_2O$ (caustic soda) to the composition.

The instant compositions have a minimum foam volume of 400 mis after 40 rotation at 25° C. as measured by the foam volume test using 0.033 wt. % of the composition in 150 ppm of water. The foam test is an inverted cylinder test in which 100 ml. of a 0.033 wt. % LDL formula in 150 ppm of $H_2O$ is placed in a stoppered graduate cylinder (500 ml) and inverted 40 cycles at a rate of 30 cycles/minute. After 40 inversions, the foam volume which has been generated is measured in mls inside the graduated cylinder. This value includes the 100 ml of LDL solution inside the cylinder. The minimum foam volume with soil is 150 ml.

The following examples illustrate liquid cleaning compositions of the described invention. Unless otherwise specified, all percentages are by weight. The exemplified compositions are illustrative only and do no limit the scope of the invention. Unless otherwise specified, the proportions in the examples and elsewhere in the specification are by weight.

DESCRIPTION OF THE PREFERRED EMBODIMENTS

EXAMPLE 1

The following formulas were prepared at room temperature by simple liquid mixing procedures as previously described

| | A | B | C | D |
|---|---|---|---|---|
| Mg linear alkyl benzene sulfonate | 9 | 9 | 9 | 9 |
| Na linear alkyl benzene sulfonate | 3 | 3 | 3 | 3 |
| AEOS 1.3EO | 11.6 | 11.6 | 11.6 | 11.6 |
| APG625 | 10 | 10 | 10 | 10 |
| C8 amido propyl amine oxide | 6.3 | | | |
| C10 amido propyl amine oxide | | 6.3 | | |
| C12 amido propyl amine oxide | | | 6.3 | |
| Coco amido propyl amine oxide | | | | 6.3 |
| Sodium xylene sulfonate | 1.2 | 1.2 | 1.2 | 1.2 |
| Ethanol | 2.5 | 2.5 | 2.5 | 2.5 |
| Sodium chloride | 0.4 | 0.4 | 0.4 | 0.4 |
| Water | Bal. | Bal. | Bal. | Bal. |
| Foam vol. Without soil (ml) | 390 | 400 | 372 | 382 |
| Foam vol. With soil (ml) | 140 | 157 | 142 | 142 |
| # of miniplate | 31 | 34 | | 27 |
| Baumgartner lard removal % | 35 | 40 | | 24 |
| Cup tallow removal % | 13 | 23 | 24 | 20 |

The foam volume test is an inverted cylinder test in which 100 ml of 0.0335 wt. % of the LDL composition in 150 ppm Mg/CaCO3 hardened water is placed in a stoppered graduated cylinder (500 ml) and inverted 40 cycles at a rate of 30 cycles/minute. After 40 inversions, the foam height in the graduated cylinder is measured in ml's. After the volume is measured for this initial 40 cylinder inversions, the cylinder stopper is removed and 175 microliters of whole milk is added to the solution. The cylinder is then inverted for another 40 cycles and a foam volume with soil is measured. The values provided above include the 100 ml's of LDL solution inside the cylinder.

The # of miniplates is measured using an automated miniplate test. The procedure is described in great detail in U.S. Pat. No. 4,556,509. Briefly, the test is used to determine the number of theoretical plates that can be washed in a detergent solution until the foam disappears. This test is used to demonstrate the improvement in cleaning efficiency as guaged by foam volume and foam stability. In the automatic miniplate dishwashing test, foam is generated in a detergent solution by the action of an agitating brush. The foam is electronically measured by reflectance of the solution surface as Crisco (vegetable shortening) soil is added to the detergent solution at a steady rate. The disappearance of the foam determines the endpoint of the test, and the number of miniplates is then calculated based on foam duration and the rate of soil addition. For our tests the detergent solution was made at 3.333 wt. % with 150 ppm Mg/CaCO3 hardness, and was initially heated to 47° C. (116.6° F.) at the start of soil addition.

What is claimed is:

1. A light duty liquid detergent composition comprising approximately by weight:

(a) 6% to 15% of a magnesium salt of a $C_8$–$C_{18}$ linear alkyl benzene sulfonate surfactant;

(b) 1% to 5% of a sodium salt of a $C_8$–$C_{18}$ linear alkyl benzene sulfonate surfactant;

(c) 3% to 12% of a $C_{10}$ alkyl amido propyl dimethyl amine oxide;

(d) 5% to 15% of an alkyl polyglucoside;

(e) 7% to 15% of an ethoxylated $C_8$–$C_{18}$ alkyl ether sulfate surfactant; and (f) the balance being water wherein the composition does not contain a glycol ether solvent, an ethoxylated and/or propoxylated nonionic surfactant, a zwitterionic surfactant, a polyoxyalkylene glycol fatty acid, a builder, a polymeric thickener, an acid, a clay, a fatty acid alkanol amide, abrasive, silicas, triclosan, alkaline earth metal carbonates, alkyl glycine surfactant, cyclic imidinium surfactant, an amine oxide having $C_8$–$C_9$ carbon atoms, and an amine oxide having $C_{11}$–$C_{24}$ carbon atoms and the composition contains no more than 0.2 wt. % of a perfume or water insoluble hydrocarbon.

2. A light duty liquid composition according to claim 1 which includes, in addition, 0.5% to 8% by weight of a solubilizing agent which is selected from the group consisting of ethanol, sodium chloride, a water soluble salts of $C_1$–$C_3$ substituted benzene sulfonate hydrotropes and mixtures thereof.

3. A light duty liquid composition according to claim 1 further including a preservative.

4. A light duty liquid composition according to claim 1 further including a color stabilizer.

* * * * *